US011246773B2

(12) United States Patent
Küschall

(10) Patent No.: US 11,246,773 B2
(45) Date of Patent: Feb. 15, 2022

(54) FOLDING WHEELCHAIR

(71) Applicant: Rainer Küschall, Allschwil (CH)

(72) Inventor: Rainer Küschall, Allschwil (CH)

( * ) Notice: Subject to any disclaimer, the term of this patent is extended or adjusted under 35 U.S.C. 154(b) by 0 days.

(21) Appl. No.: 16/962,141

(22) PCT Filed: Jan. 15, 2019

(86) PCT No.: PCT/EP2019/050893
§ 371 (c)(1),
(2) Date: Jul. 14, 2020

(87) PCT Pub. No.: WO2019/138126
PCT Pub. Date: Jul. 18, 2019

(65) Prior Publication Data

US 2020/0405551 A1 Dec. 31, 2020

(30) Foreign Application Priority Data

Jan. 15, 2018 (CH) ..... 00040/18

(51) Int. Cl.
*A61G 5/08* (2006.01)
*A61G 5/12* (2006.01)

(52) U.S. Cl.
CPC ..... *A61G 5/0825* (2016.11); *A61G 5/0866* (2016.11); *A61G 5/0883* (2016.11); *A61G 5/128* (2016.11)

(58) Field of Classification Search
CPC .... A63H 29/24; A61G 5/0825; A61G 5/0883; A61G 5/08; A61G 5/128; A61G 5/0866
(Continued)

(56) References Cited

U.S. PATENT DOCUMENTS 4,101,143 A * 7/1978 Sieber ..... A61G 5/1043 280/42
5,496,050 A * 3/1996 Geiger ..... A61G 5/08 280/250.1

(Continued)

FOREIGN PATENT DOCUMENTS

WO 2007029131 A1 3/2007
WO WO-2007029131 A1 * 3/2007 ..... A61G 5/1062

OTHER PUBLICATIONS

Translation of WO 2007029131 A1 obtained from www.espacenet.com, accessed on Apr. 7, 2021. (Year: 2007).*

(Continued)

*Primary Examiner* — James A Shriver, II
*Assistant Examiner* — Hilary L Johns
(74) *Attorney, Agent, or Firm* — Medler Ferro Woodhouse & Mills PLLC

(57) ABSTRACT

A folding wheelchair is disclosed having a frame with two side portions, a seat and a folding mechanism. The folding mechanism has coupling connections, pivoting connections and a cross-strut with two bars crossing at a pivot point. First ends of each of the cross-strut bars are mounted rotatably on the side portions of the frame via the pivoting connections. Second ends of each of the cross-strut bars are releasably mounted on the other of the two side portions of the frame via the coupling connections. A distance between the frame side portions may be modified if the cross-strut bars second ends are released from the frame side portions. The cross-strut bars are pivoted relative to each other about the pivot point. The cross-strut extends from the first ends to the second ends of the bars in a cross-strut direction which, in the operating position, extends substantially along the seat.

14 Claims, 6 Drawing Sheets

(58) Field of Classification Search
USPC ..... 180/65.1; 280/649
See application file for complete search history.

(56) References Cited

U.S. PATENT DOCUMENTS

| | | | | |
|---|---|---|---|---|
| 6,164,674 | A * | 12/2000 | Rogers | A61G 5/08 280/250.1 |
| 6,279,934 | B1 * | 8/2001 | Womack | A61G 5/02 280/249 |
| 6,499,762 | B1 * | 12/2002 | Rogers | A61G 5/0883 280/650 |
| 9,655,794 | B2 * | 5/2017 | Bednarz, III | A61G 5/0816 |

OTHER PUBLICATIONS

International Search Report dated Apr. 17, 2019 in International Appl No. PCT/EP2019/050893.

* cited by examiner

FOLDING WHEELCHAIR

TECHNICAL FIELD

The invention relates to a folding wheelchair according to the preamble of independent claim 1.

Such folding wheelchairs—having a frame comprising two side portions, a seat and a folding mechanism, in which frame the folding mechanism comprises two coupling connections, two pivoting connections and a cross-strut with two bars crossing at a pivot point, a first longitudinal end of each of the two bars of the cross-strut being mounted rotatably on one of the two side portions of the frame via one of the pivoting connections, a second longitudinal end of each of the two bars of the cross-strut being mounted releasably on the other of the two side portions of the frame via one of the coupling connections, the two bars of the cross-strut at the pivot point being pivotable relative to each other, and a distance between the side portions of the frame being modifiable if the second longitudinal ends of the two bars of the cross-strut are released from the side portions of the frame, the bars of the cross-strut being pivoted relative to each other about the pivot point—can be easily folded up and unfolded. In this way, they can be efficiently changed between an operating position, in which they can be driven by users, and a folded position, in which they can be stored away to save space and loaded into a car, for example.

BACKGROUND

Wheelchairs nowadays, in addition to being used as a means of transport, often have to meet requirements for convenient and easy handling when they are not in use. Among other things, wheelchairs are known in foldable designs which, when folded, can be stowed away in a space-saving manner, for example in a car, or can also be carried relatively easily.

Practical and robust foldable wheelchairs often include a folding mechanism with a cross-strut. The cross-strut of such a wheelchair usually has two bars which intersect at a pivot point and are pivotable about it and which are oriented vertically. Typically, the bars are mounted rotatably on their lower longitudinal ends via a pivoting connection on one side portion of a frame of the wheelchair and on their upper longitudinal ends via a coupling connection on the other of the side portions. To fold up the chair, a distance between the side portions of the frame is reduced, the upper longitudinal ends of the two bars of the cross-strut being decoupled from the side portions of the frame. The bars of the cross-strut are pivoted relative to each other about the pivot point. Such or a wheelchair or a similar one is described, for example, in U.S. Pat. No. 5,496,050 A.

A difficulty that frequently arises with foldable wheelchairs is that they are manufactured or assembled in a fixed size. Thus, for example, the size of the cross-strut or the length of its bars can determine how wide the wheelchair is when unfolded. The width of the seat is thus determined by the cross-strut. Accordingly, series of differently dimensioned cross-struts are often provided, a suitable cross-strut installed in the wheelchair depending on the seat width to be achieved. The logistical effort involved in providing folding wheelchairs can be relatively high, thereby having a disadvantageous effect on their economy.

Another difficulty that occurs with foldable wheelchairs of the type mentioned is that the wheelchairs are still relatively bulky even when folded. For example, the folded cross-struts typically prevent a backrest portion of the frame from being folded forward. The base height or the height dimension of the folded-up wheelchair of the known type is also relatively large.

The object of the present invention is therefore to propose a foldable wheelchair which is robust and can be folded up efficiently to a relatively small size. In addition, it is an object of the invention to achieve an efficient adjustment or design of the seat width of the folding wheelchair.

BRIEF SUMMARY

According to the invention, these objects are achieved by a folding wheelchair as defined in independent claim 1. Advantageous embodiments of the invention result from the dependent claims.

The essence of the invention is as follows: A folding wheelchair, which can be folded up and unfolded between an operating position and a folded position, comprises a frame having two side portions, a seat and a folding mechanism. The folding mechanism has two coupling connections, two pivoting connections and a cross-strut with two bars crossing at a pivot point. Each of the first longitudinal ends of the two bars of the cross-strut is mounted rotatably on one of the pivoting connections on one of the two side portions of the frame. Each of the second longitudinal ends of the two bars of the cross-strut is movably mounted via one of the coupling connections on the other of the two side portions of the frame along the other side portion of the frame. The second longitudinal ends can be mounted releasably on the side portions of the frame. The two bars of the cross-strut at the pivot point are pivotable relative to each other. To fold up the chair, a distance between the side portions of the frame can be modified or reduced by moving the second longitudinal ends of the two bars of the cross-strut from the side portions of the frame along the other side portion of the frame. The bars of the cross-strut are pivoted relative to each other about the pivot point.

In connection with the folding wheelchair according to the invention, the term "seat" may refer to a seat pad which carries or supports a user during operation of the folding wheelchair. The seat may be sprung and/or upholstered, for example, by means of a cushion.

The term "operation" in connection with the operating position and with the use of the folding wheelchair is understood to mean a state in which the folding wheelchair is set up and used or can be used as intended. In particular, the folding wheelchair can be used or driven by a user for locomotion during operation.

In connection with the cross-strut, the term "bar" is understood to mean a longitudinal element. In particular, it can be in the form of a rail, bar, post or tube and have any cross section, for example angular, round or oval.

The cross-strut extends from the first longitudinal ends of the two bars to the second longitudinal ends of the two bars in a cross-strut direction which, in the operating position, extends substantially along the seat. The pivoting connections, the coupling connections, or the pivoting connections and the coupling connections can be offset towards the two side portions of the frame along the cross-strut direction.

The cross-strut direction can be quasi-horizontal, in particular in the operating position of the folding wheelchair. Because the cross-strut extends substantially along the seat, it can be located in a plane that is quasi-parallel to the seat. Therefore, the cross-strut can likewise be quasi-horizontal. The term "quasi-horizontal" leaves it open whether there is a slight deviation from a precise horizontal orientation. For example, the seat of the folding wheelchair in the operating position can be slightly lower in the back, so that a user of the wheelchair sits securely in the seat, and the cross-strut can analogously be exactly horizontal or be slightly lower in the back.

The term "substantially along the seat" can refer to an arrangement in a plane parallel to the seat or to a seat plane, whereby this plane can be angled relative to the seat plane by a maximum of 30°, a maximum of 20°, a maximum of 10 or a maximum of 5°. Because it is possible that, in certain embodiments, the seat is not exactly within one plane, the term "seat level" can refer to a notional plane on which a user of the folding wheelchair sits during operation. For example, the seat can be formed by a textile which is arranged between the side portions of the frame and which hangs slightly towards the center. Such a seat nevertheless forms an at least notional seat level on which the user can sit. Typically, however, the seat comprises a cushion for accommodating the buttocks of a user, which is oriented, for example, horizontally and has a more or less flat surface. The alignment of the cross-strut along the seat enables the folding wheelchair to be comparatively compact when folded.

When the distance between the side portions of the frame is modified and the associated pivoting of the bars of the cross-strut at the pivot point relative to each other, the angles between the bars are modified. The angles between the bars facing the side portions can be increased when the distance between the side portions is reduced. At the same time, the other two angles between the bars can be reduced.

The frame can be a tube construction as a whole or for the most part. The side portions or side frames can also advantageously be produced as flat elements from a relatively light material such as carbon, as a tubular structure or as a combination thereof.

The term "offsettable" in connection with the pivoting or coupling connections may refer to a movement along the cross-strut direction, wherein they can be locked to the side portions. In particular, such an offset can relate to a flexible determination of the position of the coupling connections at a plurality of locations along the cross-strut direction. In this case, on the one hand, the offset can be freely selected at predetermined positions according to steps, or, on the other hand, it can also be accomplished steplessly at any position over a predetermined range or extent.

In particular, such an offset can be used to determine a range of motion of the cross-strut. As a result, a distance between the side portions of the frame in the operating position can be defined or set. For example, because such an offset leads to a distance between the pivoting connection and coupling connection being reduced in a side portion, a distance between the side portions and thus a seat width is increased.

This aspect of the invention thus enables different seat widths to be implemented in folding wheelchairs by means of the same folding mechanism. This enables a dealer, for example, to not have to have suitable folding wheelchairs in stock for every seat width dimension. Instead, he can adjust the seat width on-site by means of the folding mechanism on each individual folding wheelchair to meet the needs of a user. For this purpose, the folding wheelchair can be designed in such a way that the offset must be carried out by a specialist, for example using a specific tool. For example, the dealer would customize or assemble the folding wheelchair for the user. Or it can be designed in such a way that the movement is carried out by the user himself. This means that the folding wheelchair can also be used by a plurality of users who require a different seat width. The flexible offset and the associated adjustment of the seat width dimension can also enable the folding wheelchair to be reused. It enables the cost of providing folding wheelchairs to be reduced, which can significantly improve accessibility to such folding wheelchairs.

In summary, the folding wheelchair according to the invention in a robust design enables efficient folding to a comparatively small size and, at the same time, flexible adjustment of the seat width or the seat width dimension.

The pivoting connections of the folding mechanism preferably each comprise a joint via which one of the bars of the cross-strut is articulated on one of the side portions of the frame. Such a joint can enable a robust pivoting connection.

The coupling connections of the folding mechanism are preferably each formed with a fixing structure which can be fastened to the associated one of the two side portions of the frame at different points along the cross-strut direction. The different locations along the cross-strut direction allow the pivoting of the bars in the operating position to be adjusted relative to each other. This allows a seat width to be specified or predefined. The different locations can be continuous or flowing or else latched or at selected points over a certain area of the side portions.

In a preferred embodiment, the fixing structures of the coupling connections of the folding mechanism each have a clamping device which can be fastened by clamping to the associated one of the two side portions of the frame. Such a clamping structure enables efficient mounting at any position or continuous mounting. This enables the seat width to be offset and adjusted steplessly.

In another preferred embodiment, the fixing structures of the coupling connections each have a latching device, and the side portions of the frame are equipped with counter-latching structures which cooperate with the latching device of the fixing structure of the respectively associated coupling connections for fastening. Such a configuration can enable a comparatively robust coupling and a stepped offset.

The latching devices of the fixing structures of the coupling connections may each be equipped with an engagement part and the counter-latching structures of the side portions of the frame can each be provided with teeth. Or the latching devices of the fixing structures of the coupling connections may each be equipped with a pin, and the counter-latching structures of the side portions of the frame can each be equipped with a pin receptacle. The pin receptacles can be designed as perforations or blind holes.

Preferably, the folding mechanism comprises a first intermediate structure which is arranged between the first longitudinal ends of the two bars of the cross-strut and the side portions of the frame, and a second intermediate structure which is arranged between the second longitudinal ends of the two bars of the cross-strut and the side portions of the frame. Such intermediate structures enable the folding mechanism to be made robust, which can ensure that the side portions are held at a plurality of points. Tilting or bending of the side portions can thereby be prevented.

The folding wheelchair preferably comprises two drive wheels, which in the operating position are each mounted on one of the side portions of the frame. The drive wheels are preferably mounted on the side portions of the frame by means of a manually operated quick-release fastener.

The two side portions of the frame preferably carry the seat in the operating position. This enables an efficient and robust design of the seat or the folding wheelchair.

The folding wheelchair preferably comprises two steering wheels and the frame has a front portion on which the steering wheels are mounted. The folding wheelchair preferably comprises a footrest which is mounted on the front portion of the frame. The footrest can be a rigid construction that can be folded up, folded or removed, for example, while the distance between the side portions of the frame is being reduced. Such a rigid construction can form a robust support that contributes to the stability of the folding wheelchair in the operating position. As an alternative to this, the footrest can also be formed by a textile or soft or flexible construction which is folded up while the distance between the side portions of the frame is reduced. Such a footrest can promote a particularly efficient folding of the folding wheelchair.

The front portion of the frame preferably comprises two foot tubes which each extend from one of the side portions of the frame and on which one of the two steering wheels is mounted in each case. The foot tubes can, for example, branch off quasi-horizontally from the side portions and, via a bend, extend downward more or less vertically or in the operating position along the user's lower legs.

The folding wheelchair preferably comprises a backrest, and the frame has a rear portion on which the backrest is mounted. The backrest can be oriented substantially vertically in the operating position. In particular, it can serve to support the back of the user during operation of the folding wheelchair. The rear portion of the frame is preferably foldable to the side portions of the frame, so that the backrest is folded forward in the folded position. In this way, the backrest can be folded forward onto the lower-positioned seat, which can significantly reduce the height of the folding wheelchair in the folded position. In particular, the combination of a cross-strut arranged along the seat and a foldable backrest enables the folding wheelchair to be extremely compact in the folded position and therefore comparatively easy to handle.

The side portions of the frame preferably each have a guide structure, and the coupling connections of the folding mechanism each comprise a sliding part which is coupled to the guide structure of one of the side portions and is movable along this guide structure. The guide structures can be designed as rails or coulisses in the side portions. Such guide structures and sliding parts enable the second longitudinal ends of the two bars of the cross-strut to be moved efficiently and accurately along the side portions of the frame. In particular, each side portion can be equipped with two guide structures and the coupling connections can each be equipped with two sliding parts, which are each coupled to one of the two guide structures of the associated side portion. This can increase the stability of the guided movement.

The pivot point of the bars of the cross-strut of the folding mechanism is preferably formed by a coupling element, the coupling element comprising two rotating parts which are pivotable relative to each other, of which the one rotating part is rigidly connected to the one of the two bars of the cross-strut of the folding mechanism and the other rotating part is rigidly connected to the other of the two bars of the cross-strut of the folding mechanism. On the one hand, such a coupling part enables a clean, stable mounting of the bars at the pivot point. On the other hand, it also enables the bars to be rotated in a guided and secure manner relative to each other. As a result, an angle between the respective spreading of the bars can be modified efficiently, as a result of which a distance between the side portions of the frame and thus its seat width is also modified.

The two rotating parts of the coupling element can preferably be locked to each other in a plurality of different rotational positions. Such a locking means that the bars or their spread can be fixed flexibly to each other. This allows the distance between the side portions of the frame to be specified and also fixed. This enables the wheelchair seat width to be adjusted efficiently. Such a locking mechanism can also be designed so that the bars can be locked at predetermined angles or spreading with respect to each other. So, the possible distances between the two side portions of the frame and its possible seat widths can be preset.

Various mechanisms are possible for locking the two rotating parts that enable the seat width to be adjusted in steps or steplessly. For example, the rotating parts can be locked together by means of bolts reaching into openings or by screwing or jamming. The coupling element preferably has teeth which lock the two rotating parts to each other in the plurality of different rotational positions. The teeth can be formed on the two rotating parts. It can also be formed on another component of the coupling element, such as the axis of rotation described below. By means of such teeth, the rotating parts can be locked to each other efficiently at predetermined rotational positions. As a result, the angle or the spreading of the bars with respect to each other and thus the distance between the two side portions of the frame can also be predetermined. The frame can thus be designed efficiently to be set in different predetermined seat widths.

In particular, the coupling element preferably has an axis of rotation, which is coupled to the two rotating parts, and an operating element, the axis of rotation comprising the teeth and the control element being engageable in the teeth at different positions, so that the rotating parts are locked to each other in the plurality of different rotational positions. Such an implementation enables the rotating parts to be rotated in a guided, intended manner. In addition, a convenient and safe adjustment of the seat width can be implemented.

The control element is preferably spring-mounted to the axis of rotation. In particular, it can be spring-loaded so that it is pulled into the teeth without a tensile or compressive force. It can thereby be achieved that the control element engages or latches into the teeth and the bars are locked to each other without a user being actively involved. This enables a safe adjustment of the seat width of the wheelchair.

The distance between the side portions of the frame can preferably be varied in a range from approximately 30 cm to approximately 55 cm or in a range from approximately 36 cm to approximately 45 cm. Such an adjustment range enables the wheelchair to be adjusted steplessly or in predetermined positions in the usual seat widths implemented as standard.

In particular, the distance between the side portions of the frame can preferably be modified in predefined steps, for example of approximately 36 cm, approximately 38 cm, approximately 40 cm, approximately 42 cm and approximately 45 cm. This enables the possible seat widths of the wheelchair to be set in particular to the standard values.

BRIEF DESCRIPTION OF THE DRAWINGS

Further advantageous refinements of the invention result from the following description of exemplary embodiments of the invention with the aid of the schematic drawings. In particular, the folding wheelchair according to the invention is described in detail below with reference to the accompanying drawings using exemplary embodiments.

DETAILED DESCRIPTION

Figure 1:
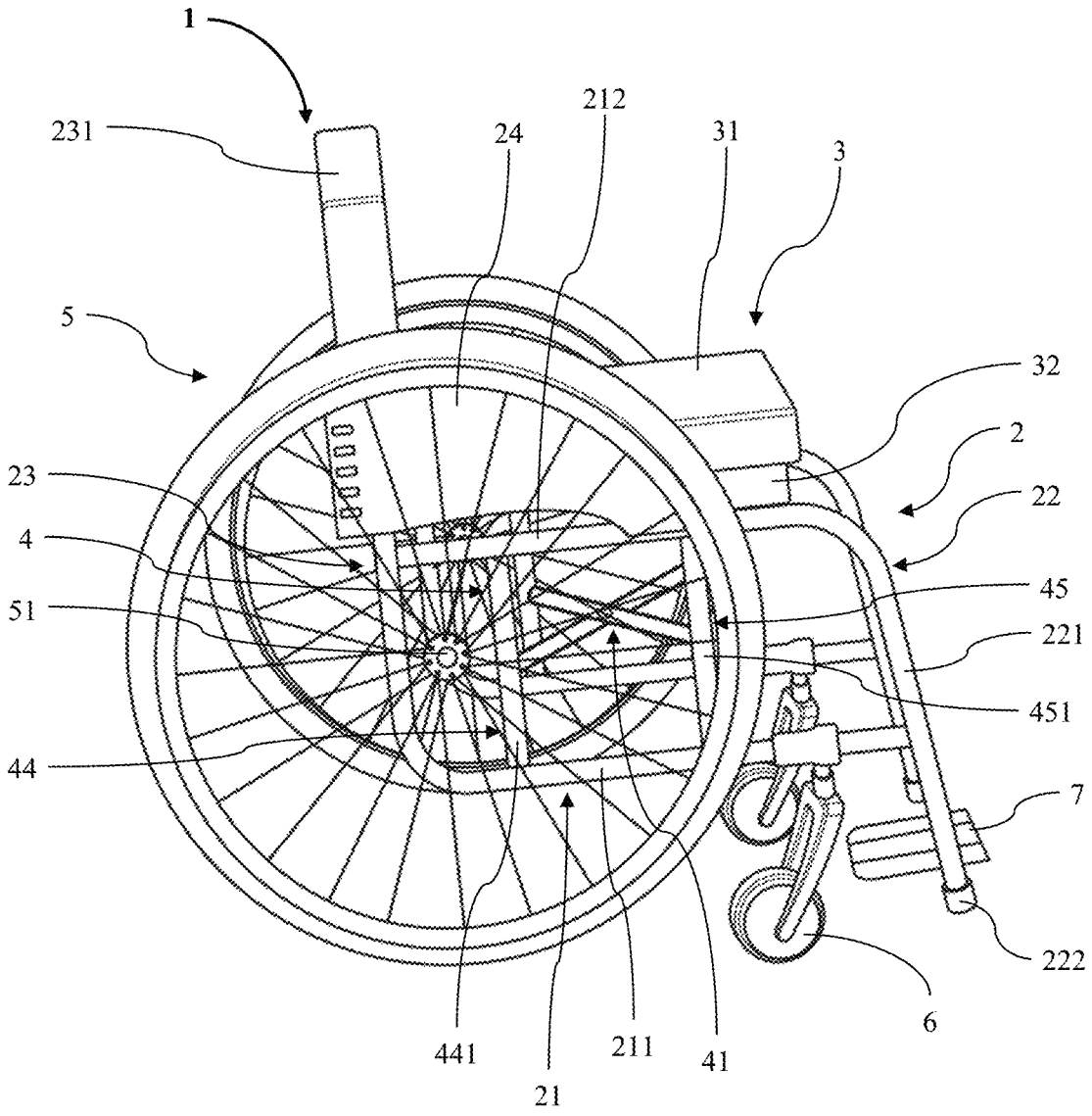
FIG. 1 is a perspective view of a first exemplary embodiment of a folding wheelchair according to the invention.

Certain terms are used in the following description for practical reasons and are not meant to be limiting. The words "right," "left," "below" and "above" indicate directions in the drawing to which reference is made. The terms "inward," "outward" "below," "above," "left," "right" or similar are used to describe the arrangement of designated parts relative to each other, the movement of designated parts relative to each other and the directions towards or away from the geometric center of the invention and designated parts thereof as shown in the figures. This spatial relative information also includes different positions and orientations than those shown in the figures. For example, if a part shown in the figures is turned over, elements or features that are described as "below" are then "above." The terminology includes the words expressly mentioned above, derivatives of the same, and words of similar meaning. The terms "front" and "rear" are used in connection with the folding wheelchair, so that the area of the folding wheelchair which is designed to accommodate the feet of a user is at the front and the area which is designed to accommodate the back is at the rear. The typical direction of travel is accordingly toward the front or forward.

In order to avoid repetitions in the figures and the associated description of the different aspects and exemplary embodiments, certain features are to be understood as common for different aspects and exemplary embodiments. The omission of an aspect in the description or a figure does not suggest that this aspect is missing in the associated exemplary embodiment. Rather, such omission can serve for clarity and prevent repetitions. In this context, the following definition applies to the entire further description: If reference numerals are included in a figure for the sake of clarity in the drawing but are not mentioned in the directly associated description text, reference is made to their explanation in the preceding description of the figures. If reference symbols are also mentioned in the description text belonging directly to a figure, which are not contained in the associated figure, reference is made to the preceding and following figures. Similar reference numerals in two or more figures stand for similar or identical elements.

FIG. 1 shows a first exemplary embodiment of a folding wheelchair 1 according to the invention. The folding wheelchair 1 comprises a frame 2, which is predominantly designed as a tubular construction, a seat 3, a folding mechanism 4, two larger drive wheels 5 and two smaller steering wheels 6. The frame 2 is formed symmetrically in two parts with a left and a right tubular construction. It has a plurality of corresponding two-part portions and in particular a front portion 22 in the front, a rear portion 23 and two central side portions 21 arranged between front portion 22 and rear portion 23.

The front portion 22 of the frame 2 comprises two parallel foot tubes 221, each connected via an arch to the associated side portion 21, that terminate at the bottom in foot plugs 222 made of rubber. The foot tubes 221 are connected to each other via a foldable footrest 7. They extend approximately along the lower legs of a user of the folding wheelchair when the user is sifting on it.

The side portions 21 of the frame 2 each have a quasi-horizontal top tube 212 and a bottom tube 211 extending parallel thereto at a vertical distance. The rear portion 23 of the frame 2 comprises a quasi-vertical tube on each of the two sides, a backrest 231 being attached to these tubes in such a way that it lies between the tubes. The backrest 231 can be folded forward.

The folding mechanism 4 is arranged between the two side portions 21 of the frame 2. It comprises a first or rear intermediate structure 44 with a quasi-vertical rear vertical strut 441 on each of the two sides and a second or front intermediate structure 45 with a quasi-vertical front vertical strut 451 on each of the two sides. The rear vertical struts 441 each extend on one of the two sides in a rear region of the side portions 21 of the frame 2 between the bottom tube 211 and the top tube 212. Analogously, the front vertical struts 451 each extend on one of the two sides in a front region of the side portions 21 of the frame 2 between the bottom tube 211 and the top tube 212.

The rear vertical struts 441 and the front vertical struts 451 are connected to each other via a quasi-vertical cross-strut 41 of the folding mechanism 4. The cross-strut 41 comprises two bars 411 crossing at a pivot point 412. One of the two bars 411 extends from the left rear vertical strut 441 to the right front vertical strut 541, and the other of the two bars 411 extends from the right rear vertical strut 441 to the left front vertical strut 451.

The seat 3 comprises a cushion 31 and a cushion support 32 which is connected to the two top tubes 212 of the side portion 21 of the frame 2. In particular, the top tubes 212 carry the poster carrier 32, which in turn supports the cushion 31. The top of the poster 31 defines a seat plane which extends more or less parallel to the cross-strut 41 of the folding mechanism 4. In particular, a cross-strut direction 8 extends along the seat 3.

The two drive wheels 5 of the folding wheelchair 1 are mounted on each of the two sides from the outside on a wheel suspension of the side portions 21 of the frame 1. For this purpose, they are equipped with a quick release 51, which enables simple manual assembly and disassembly. The steering wheels 6 are mounted rotatably about a vertical axis on each one of the bottom tubes 211 via associated suspensions.

The frame 2 also has two side panels 24, which are each arranged on one side of the seat 3 between the seat 3 and the drive wheel 5. They enable the user placed on the seat 3 to be protected while traveling. In FIG. 1, the folding wheelchair 1 is shown in an operating position in which it can be driven by the user.

Figure 2:
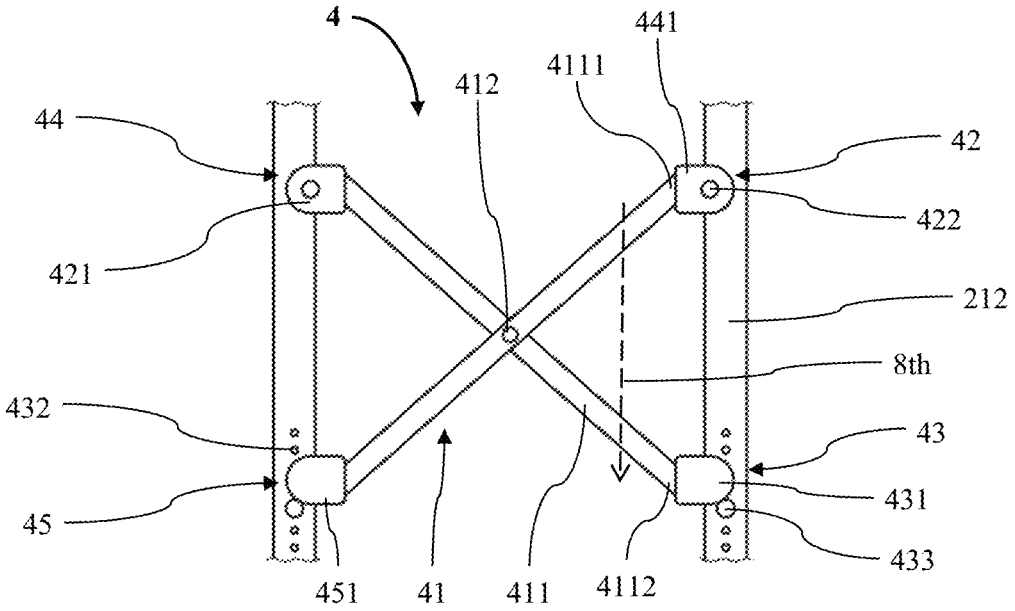
FIG. 2 is a top view of a folding mechanism of the folding wheelchair of FIG. 1 in an operating position of the first seat width.

In FIG. 2, the folding mechanism 4 is shown from above in a first seat width. The bars 411 of the cross-strut 41 each have a first or rear longitudinal end 4111 and a second or front longitudinal end 4112. The bars 411 are fastened to each of the rear vertical struts 441 at their rear longitudinal ends 4111 and to each of the front vertical struts 451 at their front longitudinal ends 4112.

The folding mechanism 4 further comprises two rear pivoting connections 42 and two front coupling connections 43. The pivoting connections 42 are each formed from a socket 421 molded onto the upper end of the rear vertical strut and a joint 422 connected to the associated top tube 212. The pivoting connections 42 allow the bars 411 of the cross-strut 41 to be pivoted relative to the top tubes 212 about a quasi-vertical axis.

The two coupling connections 43 are each formed from a socket 431 molded onto the upper end of the front vertical strut and a pin 433 of a latching device of a fixing structure which interacts with a perforation 432 as a pin receptacle in the top tube 212. In particular, the pins 433 are inserted into opposite perforations 432 in the top tubes 212 and interact with the sockets 431, so that the front vertical struts 451 are held or coupled. The pins 433 are each inserted into a selected perforation 432 of a series of perforations 432.

In FIG. 2, the pins are inserted in approximately middle perforations 432 of the row of perforations 432. The angle of rotation of the bars 411 of the cross-strut 41 about the pivot point 412 relative to each other is thus defined. As a result, a distance between the left top tube 212 and the right top tube 212 and the left lower tube 211 and the right lower tube 211 from each other and thus the distance between the side portions 21 of the frame 2 is determined. A seat width is thus predetermined, a seat 3 suitable for the selected seat width and a matching backrest 231 being able to be selected.

Figure 3:
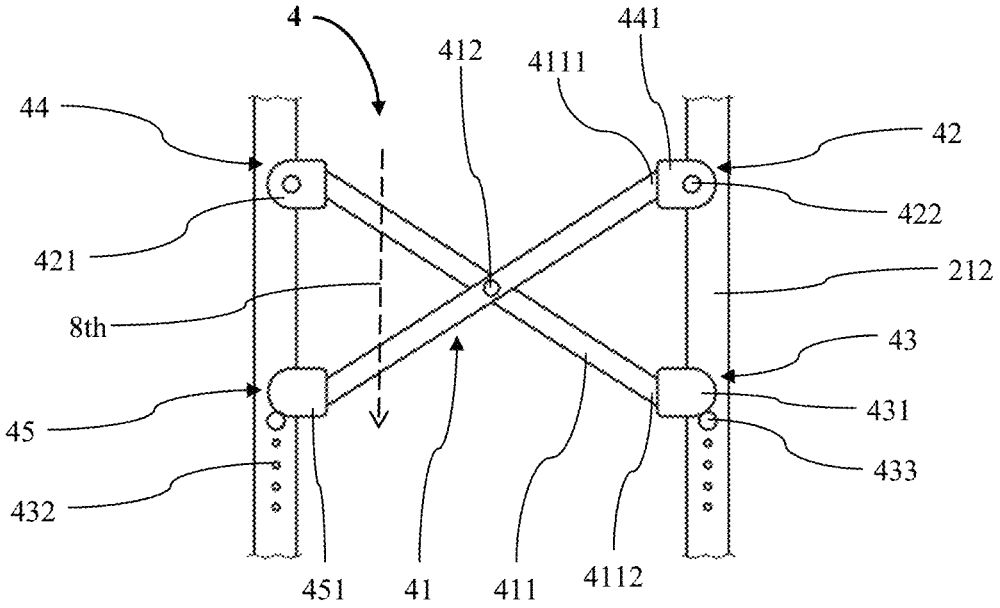
FIG. 3 is a top view of the folding mechanism of the folding wheelchair of FIG. 1 in an operating position of the second seat width.

If, as shown in FIG. 3, the pins are inserted into other perforations which are closer to the pivoting connections 42, the angles of rotation of the bars 411 of the cross-strut 41 about the pivot point 412 are modified so that the lateral angles between the bars 411 are reduced and the front and rear angles between the bars 411 are increased. As a result, a distance between the left top tube 212 and the right top tube 212 and the left bottom tube 211 and the right bottom tube 211 and thus the distance between the side portions 21 of the frame 2 is increased in comparison to FIG. 2. Again, a seat 3 suitable for the selected larger seat width and a suitable backrest 231 can now be selected.

Figure 4:
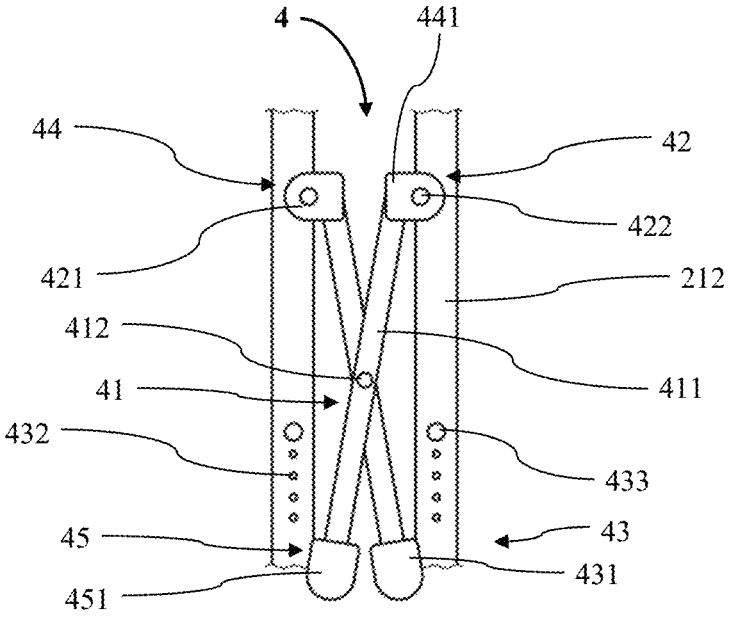
FIG. 4 is a top view of the folding mechanism of the folding wheelchair of FIG. 1 in a folded position.

FIG. 4 shows the folding mechanism 4 of the folding wheelchair 1 folded up in a folded position. The sockets 431 of the front vertical struts 451 are decoupled or released from the side portion and pivoted forward. In particular, the two bars 411 of the cross-strut 41 are pivoted relative to each other about the pivot point 412 in such a way that the lateral angles between the bars 411 are maximal and the front and rear angles between the bars 411 are minimal. As a result, the two sides of the frame 2 are maximally moved towards each other, so that a distance between them is minimal.

Figure 5:
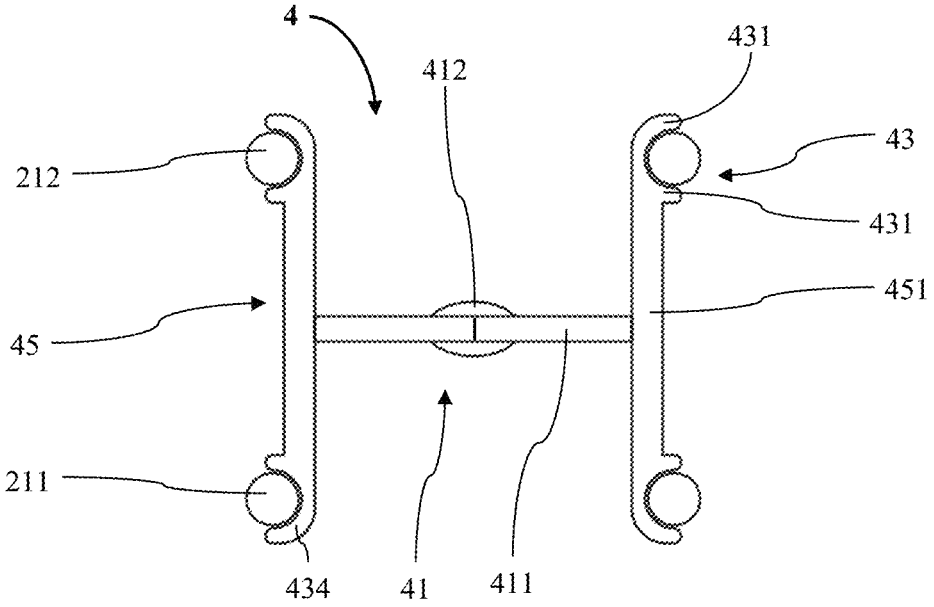
FIG. 5 is a front view of the folding mechanism of the folding wheelchair of FIG. 1 in the operating position of the first seat width.

In FIG. 5, the folding mechanism 4 is shown from the front. It can be seen that the front vertical struts 451 of the front intermediate structure 45 each have a lower socket 432 in addition to the upper sockets 431. The lower sockets 432 encompass the bottom tubes 211 of the side portion 21 of the frame 2. The frames 431, 432 are each quasi-C-shaped in cross section.

Figure 6:
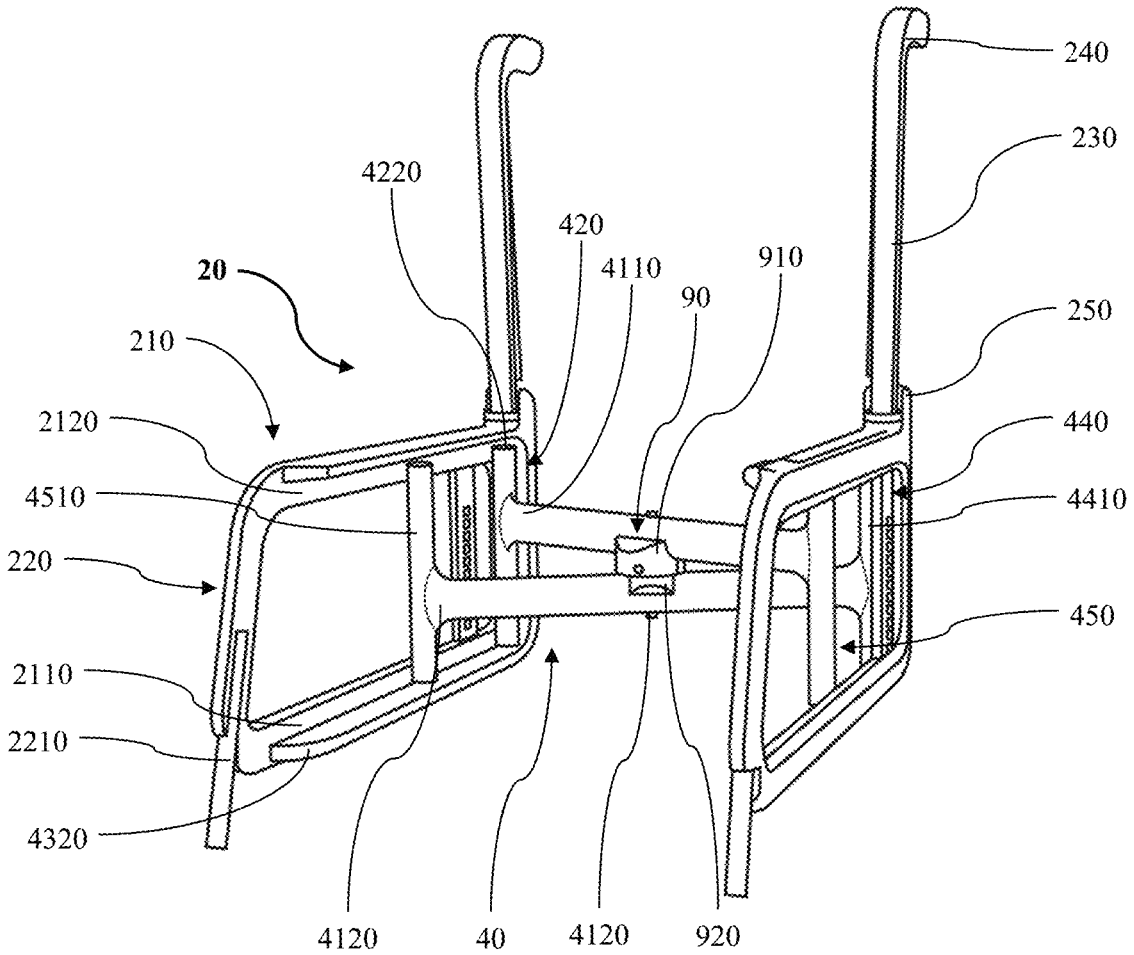
FIG. 6 is a perspective view of a frame of a second exemplary embodiment of a folding wheelchair according to the invention in an operating position.

FIG. 6 shows a frame 20 with a folding mechanism 40 of a second exemplary embodiment of a folding wheelchair according to the invention. The folding wheelchair further comprises a seat, two larger drive wheels and two smaller steering wheels, all of which are not shown in FIG. 6. The frame 20 is symmetrical with a front portion 220 in the front, a rear portion 230 and two middle side portions 210 arranged between front portion 220 and rear portion 230.

The front portion 220 of the frame 20 comprises two parallel foot tubes 2210, each connected via an arch to the associated side portion 210, that can be connected at the bottom to a footrest. The side portions 210 of the frame 20 each have a quasi-horizontal top tube 2120 and a bottom tube 2110 extending parallel to it at a vertical distance. The top tubes 2120 and the bottom tubes 2120 are each equipped with a coulisse 4320 as a guide structure. The rear portion 230 of the frame 20 comprises on each of the two sides a quasi-vertical tube which terminates in each case in a handle 240, a backrest being attachable to these tubes in such a way that it is situated between the tubes. The backrest 231 can be folded forward via folding joints 250 arranged between the rear portion 230 and the side portions.

The folding mechanism 40 is arranged between the two side portions 210 of the frame 20. It comprises a first or rear intermediate structure 440 with a quasi-vertical rear vertical strut 4410 on each of the two sides and a second or front intermediate structure 450 with a quasi-vertical front vertical strut 4510 on each of the two sides. The rear vertical struts 4410 each extend on one of the two sides in a rear region of the side portions 210 of the frame 20 between the bottom tube 2110 and the top tube 2120. Analogously to this, the front vertical struts 4510 each extend on one of the two sides in a front region of the side portions 210 of the frame 20 between the bottom tube 2110 and the top tube 2120.

The bars 4110 of the cross-strut 410 each have a first or rear longitudinal end 41110 and a second or front longitudinal end 41120. The bars 4110 are each fastened to the rear vertical struts 4410 at their rear longitudinal ends 41110 and to the front vertical struts 4510 at their front longitudinal ends 41120.

The rear vertical struts 4410 and the front vertical struts 4510 are connected to each other via a quasi-vertical cross-strut 410 of the folding mechanism 40. The cross-strut 410 comprises two bars 4110 crossing at a pivot point 4120. The one of the two bars 4110 extends from the left rear vertical strut 4410 to the right front vertical strut 4510, and the other of the two bars 4110 extends from the right rear vertical strut 4410 to the left front vertical strut 4510.

The pivot point 4120 is formed by a coupling element 90. The coupling element 90 comprises an upper rotating part 910 and a lower rotating part 920 rotatably connected thereto. The upper rotating part 910 is rigidly connected to the upper of the bars 4110, and the lower rotating part 920 is rigidly connected to the lower of the two bars 4110.

The folding mechanism 40 further comprises two rear pivoting connections 420 and two front coupling connections 430. The pivoting connections 420 each have a joint 4220 connected to the associated top and bottom tubes 2110, 2120. The pivoting connections 420 allow the bars 4110 of the cross-strut 410 to be turned to the top and bottom tubes 2110, 2120 about a quasi-vertical axis.

The two coupling connections 430 are respectively formed from sliding parts, which are formed by the upper and lower ends of the front vertical struts 4510, and the coulisses 4320. In particular, the lower coulisses 4320 each have an upwardly oriented horizontal sliding surface, and the upper coulisses 4320 each have a downwardly oriented horizontal sliding surface. The front vertical struts 4510 are each arranged between the coulisses 4320 of the associated side portion 210 in such a way that the vertical ends of the front vertical struts 4510 or their sliding parts rest against the sliding surfaces of the coulisses 4320. In this way, the front vertical struts 4510 can efficiently slide back and forth along the side portions 210 of the frame 20.

In FIG. 6, the folding wheelchair 10 is shown in an operating position in which it can be driven by the user. By adjustment of the folding mechanism 90, an angle between the two bars 4110 is adjusted such that a distance between the side portions 210 is set to a desired seat width. The front vertical struts 4510 of the folding mechanism 40 are moved relatively far back along the frame 20.

Figure 7:
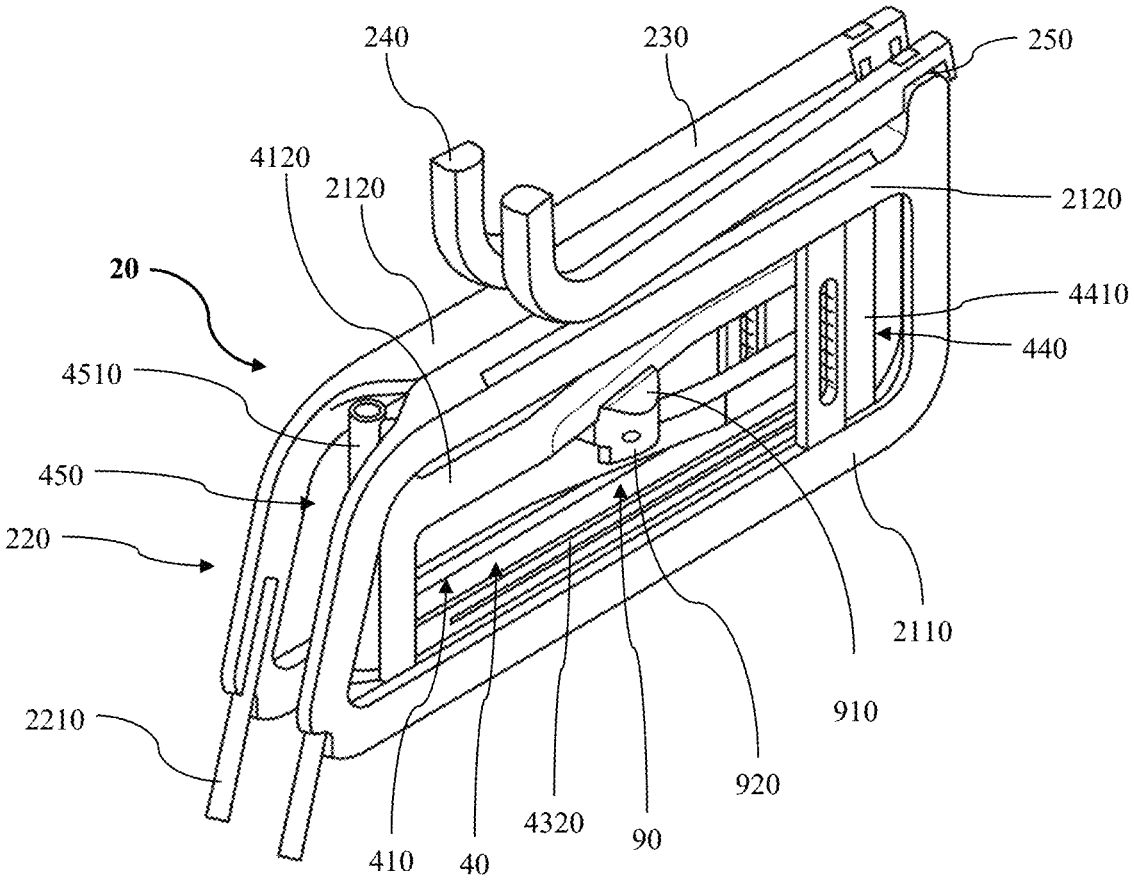
FIG. 7 is a perspective view of the frame of FIG. 6 in a folded position.

FIG. 7 shows the frame 20 in a folded position or folded up position. The upper rotating part 910 and the lower rotating part of the coupling element 90 are pivoted relative to each other such that the angles between the bars 4110 are modified such that the front vertical struts 4510 of the folding mechanism 40 are moved forward along the frame 20. The bars 4110 are also rotated via the joints 4220 to the associated side portions 210.

The rear portion 230 of the frame 20 or its tubes ending in a handle 240 are folded forward about the folding joints 250. In this folded position, the frame 20 is extremely compact.

Figure 8:
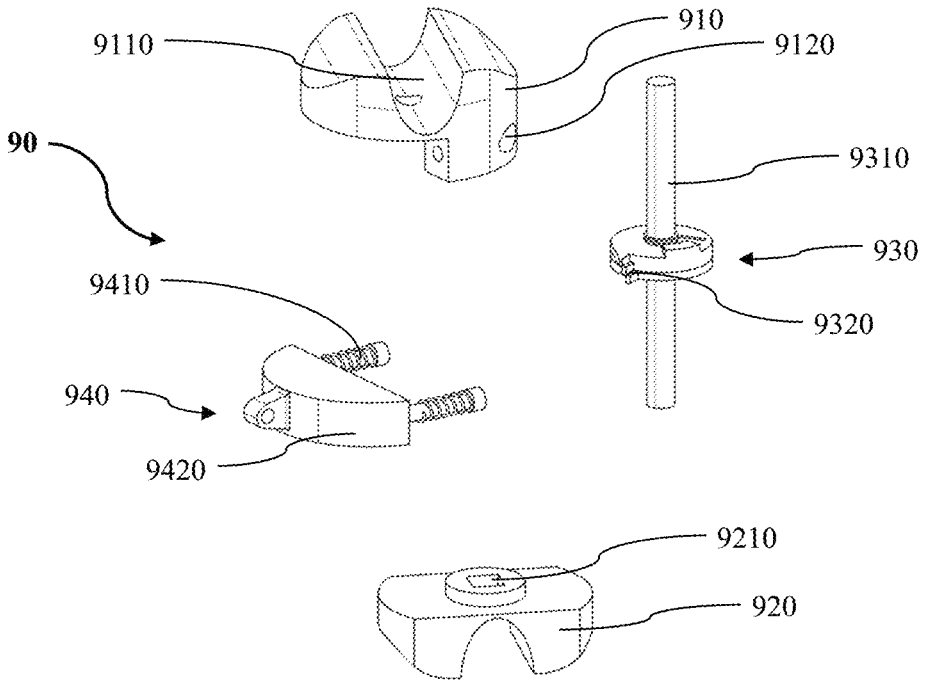
FIG. 8 is a perspective exploded view of a coupling element of the frame from FIG. 6.

In FIG. 8, the coupling element 90 is shown in detail. It can be seen here that the upper rotating part 910 and the lower rotating part 920 are each formed with a groove which is shaped for gripping and partially engaging around the bars 4110 of the cross bar 410. The coupling element 90 further comprises an axis of rotation 930 and a control element 940. The axis of rotation 930 is equipped with an axle bar 9310 and toothed pulleys 9320 as toothing. In particular, the toothed pulleys 9320 are mounted approximately in the middle of the axle bar, so that the teeth are oriented radially outwards. The control element 940 comprises a crescent-shaped latch 9420 and two springs 9410.

In the assembled state, the axle bar 9310 projects through the upper and lower rotating parts 910, 920 through vertical bores 9110, 9210 provided in each. The control element 940 is mounted on the upper rotating part 910 by means of two screws. The two screws protrude through two associated horizontal bores 9120 of the upper rotating part 910. The two springs 9410 are positioned on a side of the upper rotating part 910 facing away from the bolt 9420 in such a way that the bolt 9420 is pulled in the direction of the teeth of the axis of rotation 930. The coupling element 90 thus automatically locks the bars 410.

Although the invention is illustrated and described in detail by means of the figures and the associated description, this illustration and this detailed description are to be understood as illustrative and exemplary and not as limiting the invention. In order not to transfigure the invention, in certain cases well-known structures and techniques cannot be shown and described in detail. It is understood that those skilled in the art can make changes and modifications without departing from the scope of the following claims. In particular, the present invention covers further exemplary embodiments with any combination of features that may differ from the combinations of features explicitly described.

The present disclosure also includes embodiments with any combination of features mentioned or shown above or below for various embodiments. It also includes individual features in the figures, even if they are shown there in connection with other features and/or are not mentioned above or below. The alternatives of embodiments and individual alternatives of their features that are described in the figures and the description can be excluded from the subject matter of the invention or from the disclosed items. The disclosure includes embodiments that only include the features described in the claims or in the exemplary embodiments and also those that include additional different features.

Furthermore, the term "comprise" and derivatives thereof do not exclude other elements or steps. Likewise, the indefinite article "a" or "an" and derivatives thereof do not exclude a plurality. The functions of a plurality of features listed in the claims can be performed by a unit or a step. The terms "substantially," "about," "approximately," "quasi" and the like in connection with a property or a value in particular also define exactly the property or exactly the value. The terms "about" and "approximately" in connection with a given numerical value or range can refer to a value or range which lies within 20%, within 10%, within 5% or within 2% of the given value or range. All reference signs in the claims are not to be understood as limiting the scope of the claims.

What is claimed is:

1. A folding wheelchair, which can be folded and unfolded between an operating position and a folded position, comprising a frame with two side portions, a seat and a folding mechanism, the folding mechanism comprising two coupling connections, two pivoting connections and a cross-strut with two bars crossing at a pivot point, a first longitudinal end of each of the two bars of the cross-strut being rotatably mounted to one of the two side portions of the frame via one of the pivoting connections, a second longitudinal end of each of the two bars of the cross-strut being mounted movably along the other of the two side portions of the frame to the other of the two side portions of the frame via one of the coupling connections, the two bars of the cross-strut being pivotable at the pivot point relative to each other, and a distance between the side portions of the frame being modifiable by moving the second longitudinal ends of the two bars of the cross-strut along the other side portion of the frame, wherein the bars of the cross-strut are pivoted relative to each other about the pivot point, wherein the cross-strut extends from the first longitudinal ends of the two bars to the second longitudinal ends of the two bars in a cross-strut direction which, in the operating position, extends substantially along the seat, wherein the pivoting connections, the coupling connections or the pivoting connections and the coupling connections are displaceable along the cross-strut direction relative to the two side portions of the frame, wherein the coupling connections of the folding mechanism are each formed with a fixing structure, which can be fastened to the associated one of the two side portions of the frame at different positions along the cross strut direction, wherein the fixing structures of the coupling connections each have a latching device and the side portions of the frame are equipped with counter-latching structures which cooperate for fastening with the latching device of the fixing structure of the associated one of the coupling connections, and wherein the latching devices of the fixing structures of the coupling connections each have an engaging part and the counter-latching structures of the side portions of the frame are each equipped with teeth.

2. The folding wheelchair of claim 1, wherein the pivoting connections of the folding mechanism each comprise a joint via which one of the bars of the cross-strut is articulated on one of the side portions of the frame.

3. The folding wheelchair of claim 1, wherein the folding mechanism has a first intermediate structure which is arranged between the first longitudinal ends of the two bars of the cross-strut and the side portions of the frame, and a second intermediate structure which is arranged between the second longitudinal ends of the two bars of the cross-strut and the side portions of the frame.

4. The folding wheelchair of claim 1, comprising two drive wheels, which in the operating position are each mounted to one of the side portions of the frame, wherein the drive wheels are mounted to the side portions of the frame by means of a manually operatable quick-release fastener.

5. The folding wheelchair of claim 1, wherein the two side portions of the frame support the seat in the operating position.

6. The folding wheelchair of claim 1, comprising two steering wheels and a footrest mounted to a front portion of the frame.

7. The folding wheelchair of claim 6, wherein the front portion of the frame comprises two foot tubes, each of which extends from one of the side portions of the frame and on each of which one of the two steering wheels is mounted.

8. The folding wheelchair of claim 1, comprising a backrest wherein the frame has a rear portion to which the backrest is mounted, wherein the rear portion of the frame is foldable to the side portions of the frame so that the backrest is folded forward in the folded position.

9. The folding wheelchair of claim 1, wherein the side portions of the frame each have a guide structure and the coupling connections of the folding mechanism each comprise a sliding part which is coupled to the guide structure of one of the side portions and is movable along this guide structure.

10. The folding wheelchair of claim 1, wherein the distance between the side portions of the frame can be varied in a range from about 30 cm to about 55 cm.

11. The folding wheelchair of claim 1, wherein the distance between the side portions of the frame can be modified in predefined steps in particular of about 36 cm, about 38 cm, about 40 cm, about 42 cm and about 45 cm.

12. A folding wheelchair, which can be folded and unfolded between an operating position and a folded position, comprising a frame with two side portions, a seat and a folding mechanism, the folding mechanism comprising two coupling connections, two pivoting connections and a cross-strut with two bars crossing at a pivot point, a first longitudinal end of each of the two bars of the cross-strut being rotatably mounted to one of the two side portions of the frame via one of the pivoting connections, a second longitudinal end of each of the two bars of the cross-strut being mounted movably along the other of the two side portions of the frame to the other of the two side portions of the frame via one of the coupling connections, the two bars of the cross-strut being pivotable at the pivot point relative to each other, and a distance between the side portions of the frame being modifiable by moving the second longitudinal ends of the two bars of the cross-strut along the other side portion of the frame, wherein the bars of the cross-strut are pivoted relative to each other about the pivot point, wherein the cross-strut extends from the first longitudinal ends of the two bars to the second longitudinal ends of the two bars in a cross-strut direction which, in the operating position, extends substantially along the seat, wherein the pivoting connections, the coupling connections or the pivoting connections and the coupling connections are displaceable along the cross-strut direction relative to the two side portions of the frame, wherein the pivot point of the bars of the cross-strut of the folding mechanism is formed by a coupling element, wherein the coupling element comprises two rotating parts which are pivotable relative to each other, of which the one rotating part is rigidly connected to the one of the two bars of the cross-strut of the folding mechanism and the other rotating part is rigidly connected to the other of the two bars of the cross-strut of the folding mechanism, and wherein the two rotating parts of the coupling element can be locked to each other in a plurality of different rotational positions.

13. The folding wheelchair of claim 12, wherein the coupling element has teeth which lock the two rotating parts to each other in the plurality of different rotational positions.

14. The folding wheelchair of claim 13, wherein the coupling element has an axis of rotation, which is coupled to the two rotating parts, and a control element, wherein the axis of rotation comprises the teeth and the control element can engage in the teeth at different positions, so that the rotating parts are locked to each other in the plurality of different rotational positions, wherein the control element is mounted spring-loaded to the axis of rotation.

* * * * *